United States Patent [19]
Tonomura et al.
[11] 4,290,375
[45] Sep. 22, 1981

[54] APPARATUS FOR WRITING AND USING EMBROIDERY INFORMATION ON MAGNETIC TAPE

[75] Inventors: Yoshinobu Tonomura, Hachioji; Toshio Fujimura, Musashino; Masanori Hara; Hideaki Takenoya, both of Hachioji, all of Japan

[73] Assignee: Janome Sewing Machine Co., Ltd., Tokyo, Japan

[21] Appl. No.: 81,321

[22] Filed: Oct. 3, 1979

[30] Foreign Application Priority Data

Sep. 22, 1978 [JP] Japan ..... 53-115896
Sep. 22, 1978 [JP] Japan ..... 53-115897

[51] Int. Cl.³ ..... D05B 21/00
[52] U.S. Cl. ..... 112/121.12
[58] Field of Search ..... 112/121.12, 121.11, 112/102, 103, 158 E; 318/568

[56] References Cited

U.S. PATENT DOCUMENTS 4,135,459 1/1979 Manabe et al. ..... 112/121.12
4,142,472 3/1979 Soeda et al. ..... 112/158 E
4,190,007 2/1980 Kimura et al. ..... 112/121.12

*Primary Examiner*—Peter P. Nerbun
*Attorney, Agent, or Firm*—Michael J. Striker

[57] ABSTRACT

An automatic embroidery machine is driven by information recorded on magnetic tape and utilizes a fixed sewing machine and a movable embroidery frame. An input apparatus registers user-selected points on a coordinate analysis panel, which points form embroidery patterns to be sewn, and causes embroidery information to be recorded upon magnetic tape for subsequent use in the automatic embroidery machine. The automatic embroidery machine and the input apparatus are so designed that after a continuous part of an embroidery pattern has been sewn, the embroidery frame will be moved to a next continuous part of a pattern and the automatic embroidering machine will stop, providing an opportunity for a user to change thread. The automatic embroidering machine cannot be restarted unless the user operates a controller, ensuring safe operation.

The automatic embroidery machine is provided with a temporary memory, into which embroidery information is written while the magnetic tape is being read, and from which embroidery information is read out while the automatic embroidering machine is embroidering patterns. The input apparatus is so designed that when an amount of embroidery information corresponding to the predetermined capacity of the temporary memory has been recorded on the magnetic tape, a blank signal is next recorded thereon. The magnetic tape is repeatedly started and stopped, so that embroidery information is transferred in packets into and out of the temporary memory. This operation allows temporary memory capacity to be minimized, reducing cost.

4 Claims, 12 Drawing Figures

3: High frequency generator
4: Stylus pen
5: Coordinate analysis panel
8: Coordinate signal
9: Control signal
10: Modulation circuit
11: Magnetic tape 3: High frequency generator 4: Stylus pen 5: Coordinate analysis panel 8: Coordinate signal 9: Control signal 10: Modulation circuit 11: Magnetic tape 1: Address counter increment 2: Address counter equal capacity of RAM 3: Transfer of control signal into magnetic tape 4: Stop of transfer to provide blank signal 22 : Cassette reader 23 : Modulation circuit 35 : X-Control motor 36 : Y-Control motor 41 : Controller 42 : Machine speed control circuit 44 : Upper shaft pulse generator 45 : Connector 46 : Drive control signal 47 : Flip-Flop 48 : Embroidering speed control circuit 49 : X-Drive order 50 : Y-Drive order 51 : D/A Converter 52 : D/A Converter 53 : X-Drive circuit 54 : Y-Drive circuit 55 : Enlarging & reducing volume 56 : A/D Converter 57 : Lamp

APPARATUS FOR WRITING AND USING EMBROIDERY INFORMATION ON MAGNETIC TAPE

BRIEF DESCRIPTION OF THE INVENTION

The present invention relates to an improved input apparatus to write embroidery information on magnetic tape for use in an automatic embroidering apparatus.

In particular, the input apparatus has a coordinate analysis device which is composed of a stylus pen connected to a high frequency generator and a co-ordinate analysis panel. The coordinate analysis panel receives X-Y co-ordinate of each point of a pattern indicated by the stylus pen and converts the X-Y co-ordinate into a digital coordinate signal which is to be applied to the input of a temporary memory contained in the input apparatus. Further, the stylus pen is provided with a co-ordinate switch and a control switch. The co-ordinate switch plots the X-Y coordinate of each point of a pattern and transmits the same as a coordinate signal to the temporary memory, and the control switch is operated together with the co-ordinate switch at the final co-ordinate of a preceding continuous pattern (which will be an initial co-ordinate of a disconnected part of the pattern) and transmits a control signal to the temporary memory. The control signal displaces the embroidering frame (during automatic embroidering) to a position where the machine needle drops to the initial coordinate of the preceding continuous pattern while the sewing machine is stopped. Thus, the invention provides an opportunity for a machine operator to change thread while the sewing machine is stopped. The apparatus is also designed to avoid unexpected problems, such as movement of the sewing machine or the embroidering frame during change of thread.

The data stored in the temporary memory of the embroidring signal input apparatus are transferred onto magnetic tape. If enough embroidering data have been transferred onto the magnetic tape to fill the temporary memory, the microcomputer gives a control signal to the magnetic tape, and then acts on a magnetic tape processing device to temporarily stop the transfer of data, so as to form a blank on the magnetic tape. With that control signal of the microcomputer, the temporary memory of the apparatus stores a signal to temporarily stop the operation of a cassette recorder, thereof after the micro-computer has given the control signal reader a signal to stop the sewing machine and the embroidery frame during the automatic embroidering operation, to the magnetic tape, and issues a signal for temporarily stopping. During the transfer of data, if a signal is reached corresponding to the disconnected point of a pattern, the temporary memory stores a signal for temporarily stopping the sewing machine and the embroidering frame a the command of the microcomputer. Thus, when the sewing machine and the embroidering frame are temporarily stopped, the automatic embroidering apparatus will not operate again unless an operator controlled switch apparatus is once released and pushed again. The object is as follows: In processing the magnetic tape for producing an embroidery pattern covering almost all the space of the embroidering frame, the transfer of data is repeated several times into the tape, each time the quantity of the embroidering data stored on magnetic tape becomes equal to the capacity of the temporary memory. A smaller temporary memory can thus be used, decreasing cost of the apparatus. There is also provided a blank signal between the two continuous, but separated data to eliminate the mistakes on reading-out of the data which may be otherwise caused by instability of rising time at re-driving of the cassette reader when subsequently reading into the temporary memory of the embroidering data by the input part of the automatic embroidering apparatus.

A basic object of the invention is to stop the sewing machine and the embroidering frame at the disconnected part in the automatic embroidery for easy exchange of thread and to avoid occurence of problems caused by sudden movement of the embroidering frame.

Another object of the invention is to use a smaller capacity temporary memory for preventing the increased costs.

The other features and advantages of the invention will be apparent from the following description of the invention in reference to preferred embodiment as shown in the attached drawings.

DETAILED DESCRIPTION OF THE INVENTION

A brief reference will be made to the automatic embroidering apparatus (denoted "embroidering apparatus" hereinafter) to be driven and controlled in accordance with embroidering data from an external memory such as a magnetic tape or a magnetic card processed by the embroidering signal input apparatus of the invention (denoted "input apparatus" hereinafter).

The input apparatus is so construced as to store embroidering data, by means of the coordinate analysis panel, in the temporary memory of the micro-computer. The embroidering data composed of a co-ordinate signal for each point in a pattern on the coordinate analysis panel and an embroidering control signal. The input apparatus is further constructed to convert the embroidering data into high frequency to be stored on magnetic tape or magnetic card. The magnetic card may be also used in addition to the magnetic tape for the external memory. As both can be dealt with similarly, the following explanation will refer to magnetic tape only.

The embroidering apparatus is capable of normal stitching and embroidering the latter being controlled by the embroidering control circuit. In the embroidering operation, embroidering data on magnetic tape processed by the input apparatus is transferred into the temporary memory of the embroidering control circuit, so as to drive the sewing machine at a predetermined speed and to operate the embroidering frame per each stored in the stitches for forming the pattern under the control of the microcomputer in accordance with the data of the temporary memory.

Figure 1:
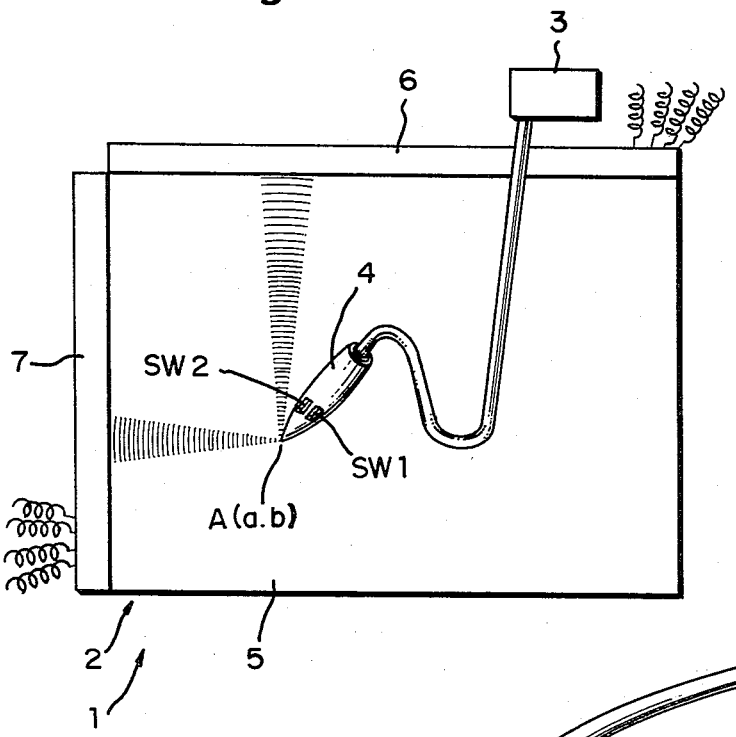
FIG. 1 is a plan view showing the co-ordinate analysis panel of the invention.
Figure 2:
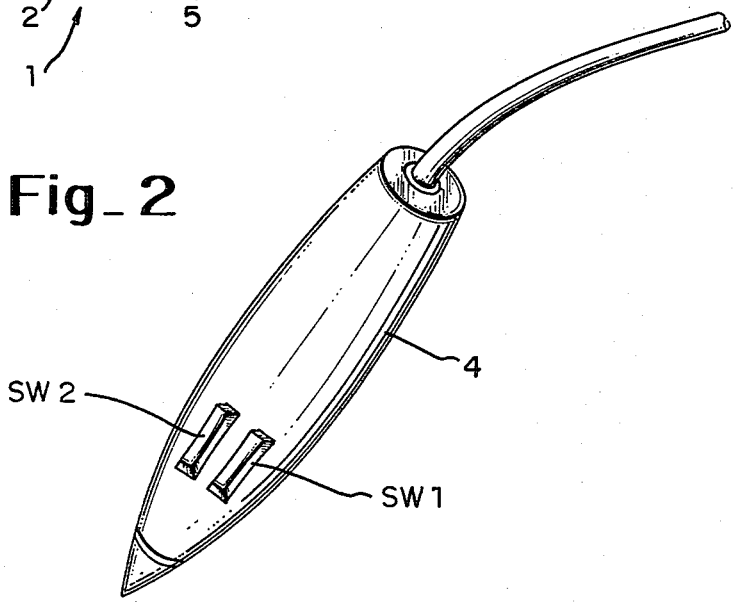
FIG. 2 is a perspective view showing the pen stylus.
Figure 3:
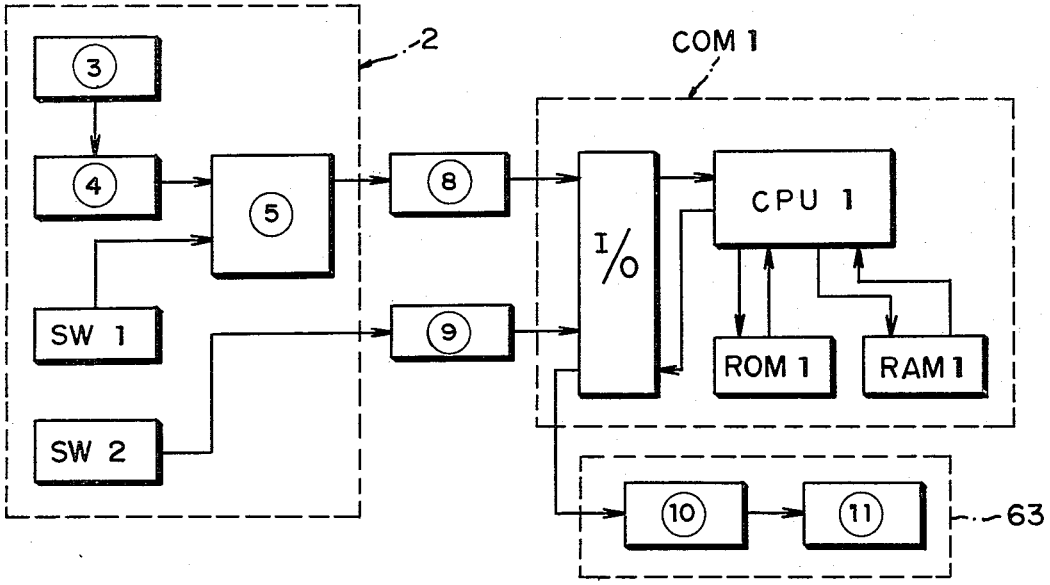
FIG. 3 is a block diagram of the embroidering signal input apparatus of the invention.

The input apparatus 1 will be explained in reference to FIGS. 1-3, in which a reference numeral 2 is the co-ordinate analyzing device of the input apparatus. The co-ordinates of the pattern on the co-ordinate analysis panel 5 are selected by the point of a stylus pen 4 which is connected to the high frequency generator 3. The selected coordinates are received by X-receipt 6 and Y-receipt 7 by pushing the co-ordinate switch SW1 and are transferred into the temporary apparatus RAM1 of the input apparatus 1 as digital coordinate signals in an addressed manner and in the plotted sequence, and later mentioned control signals 9 are given to the temporary memory RAM1 by pushing a control switch SW2 as required in the pattern formation. FIG. 1 illustrates the transfer of the co-ordinates (a, b) of A point.

After the embroidering data composed of the co-ordinate signal 8 and the control signal 9 are stored in the temporary apparatus RAM1, the micro-computer COM1 (called as "microm" hereafter) converts the stored data into the frequency via a modulation circuit 10 of the tape recorder 63. In FIG. 3, I/O is an input-output port, CPU1 is a central processing unit and ROM1 is a static memory.

Figure 4:
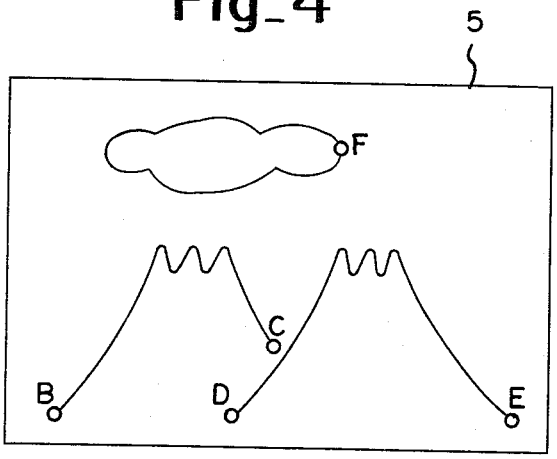
FIGS. 4 and 5 show patterns appearing on the co-ordinate analysis panel.

Input of the embroidering data to the micom COM1 will be explained with reference to FIG. 4. In the patterns in FIG. 4, distances between B-C, D-E, and E-F are continuous patterns independent of each other, and spaces between C-D, and E-F are disconnected parts.

In inputting the co-ordinate of each point of the patterns to the temporary memory RAM1, a continuous signal including each point is nonsense. Since it should inconvenient that the embroidering frame 29 (FIG. 9) is move independently of rotation of an upper shaft of the sewing machine during automatic operation by the embroidering apparatus 20 (FIG. 9), said signal is required to be a discontinuous signal which is divided by pulses that are synchronous with rotation of the upper shaft during automatic embroidering operation.

The co-ordinate switch SW1 successively addresses in the plotting order the co-ordinates at the desired positions in the pattern on the co-ordinate analyzing panel 5, in order to divide the co-ordinate signal 8 (a discontinuous signal) upper shaft synchronous pulses for giving an input to the temporary memory RAM1 of the microm COM1, and the co-ordinate signal 8 successively plotted by the co-ordinate switch is synchronized with the sewing machine by the upper shaft synchronous pulse during embroidering after said coordinate is given to and stored in the embroidering apparatus 20, and controls driving of the embroidering frame 29 for each one of the stitches of the sewing machine.

Figure 9:
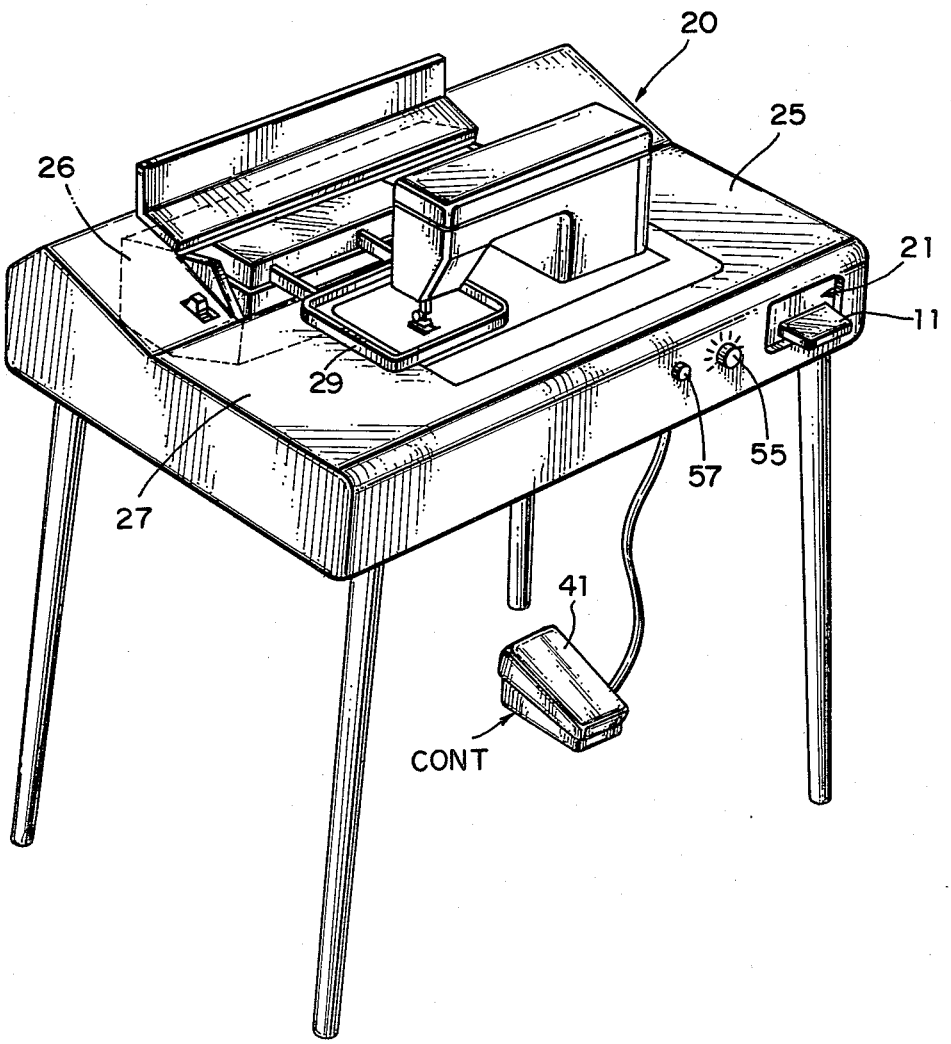
FIG. 9 is a perspective view of the automatic embroidering apparatus, shown in the automatic embroidering condition.

The control signal SW2 is for giving the control signal together with the co-ordinate signal 8 to the temporary memory RAM1 of the micom COM1 by joint use of the co-ordinate switch SW1 at a final co-ordinate of the continuous pattern, which final co-ordinate will be an initial co-ordinate of a disconnected part of the pattern. The control signal stops the sewing machine at the initial co-ordinate of the disconnected part of the pattern, and moves only the embroidering frame 29 to the initial co-ordinate of a next continous part of the pattern, stops the embroidering frame, and finally releases an operating part 41 of a controller CONT (FIG. 9). Unless this operating part is pushed once again, the sewing machine and the embroidering frame are not moved.

Thus, the sewing machine is not driven at the disconnected part of the pattern and the embroidering frame is only moved while the needle bar is held at its upper dead point. It is dangerous if the sewing machine is re-rotated after moving the embroidering frame 29 and starts to stitch the pattern, causing time for exchanging the thread to be lost.

Accordingly, in the present embodiment, the sewing machine is stopped only after the embroidering frame 29 is moved to the initial co-ordinates of a following continuous part of the pattern in accordance with the order from the micom COM2 (FIG. 11) of the embroidering apparatus 20, based on the control signal 9 by the control switch SW2. At said initial co-ordinates, a flip-flop 47 of the embroidering apparatus 20 is controlled by the micom COM2 based on said control signal. Unless controller operating part 41 (serving as a switch of an embroidering speed control circuit 48 of an embroidering control circuit 24) is released and pushed again, the embroidering speed control circuit 48 is not activated and the embroidering frame 29 is accordingly not driven.

Figure 5:
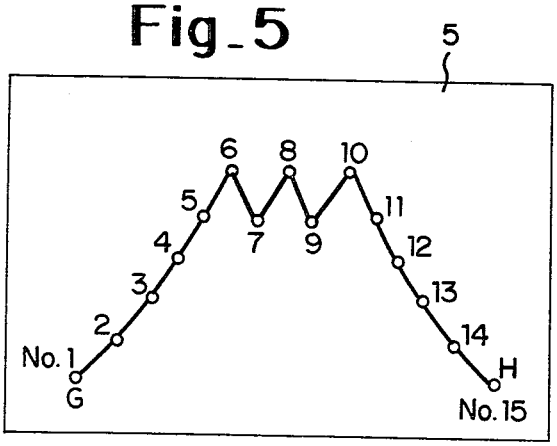
Figure 6:
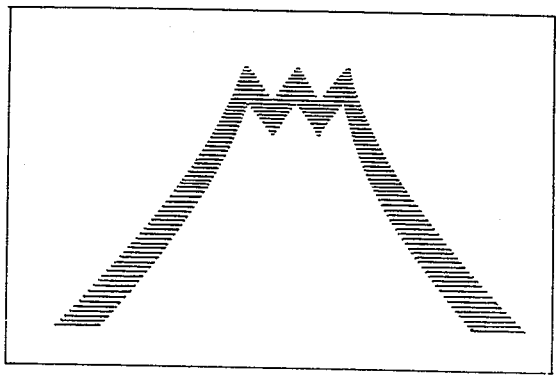
FIG. 6 shows an example of an embroidering pattern based on FIG. 5.

It is of course possible to give the co-ordinate signal thereto for each stitch in a pattern, but This will require much labor for patterns that require many stitches. A pattern viewed in FIG. 6 is made by plotting in detail the pattern in FIG. 5 per each of the stitches and giving manually swinging amplitude to the sewing machine. For fabricating such a pattern, it is necessary that rough and close stitches are plotted as uniformly as possible, since inconvenience will occur if the distance between the adjacent disconnected co-ordinates distinguishable by the co-ordinate analysis panel 5 is rough with respect to the distance between the co-ordinates between the plots.

Therefore, in the present embodiment such a process is also provided which plots, as a co-ordinate signal, a co-ordinate per each 16 stitches for giving it to the input apparatus. For example, with respect to the pattern shown in FIG. 5, the distance between G-H is properly divided into No. 1-No. 15 plots as viewed, and the input is given thereto in each plot while pushing the co-ordinate switch SW1.

Thus in the automatic embroidering operation controlled by means of the magnetic tape containing the co-ordinate signal by the plot point, the micom COM2 of the embroidering apparatus 20 (having received this signal) interpolates between No. 1-No. 2 and No. 2-No. 3, and between the plot co-ordinates, and carries out a calculation for n-divisions respectively in order to control driving of the embroidering frame 29 as forming the stitches which advances by 1/n between the respective co-ordinates. In this regard, this embodiment employs $n=16$.

It is not always necessary that an original pattern be reduced or enlarged. In this embodiment, an origin of the pattern co-ordinate is selected at a center of the co-ordinate analysis panel 5 for reducing or enlarging the pattern, and this co-ordinate is set at the central co-ordinate of the embroidering frame 29. The enlarged or reduced embroidering pattern is formed by determining a multiplication constant $\alpha$ through the manual operation of an enlarging or reducing volume 55 of the embroidering control circuit 24 for the co-ordenate signal of the thus prepared magnetic tape, converting said constant into a digital signal by A/D converter 56, and causing the micom COM2 to carry out a calculation to obtain ($\alpha x$, $\alpha y$) using a program in a static memory ROM2.

As to the preparation of the magnetic tape for the external memory of the automatic embroidering apparatus 20, the number of the plotted points varies greatly in dependence on the kind of embroidering pattern covering the whole interior of embroidering frame 29, and it is not preferable to store all of these plotted points in the temporary memory RAM2 of the automatic embroidering apparatus, since many applications do not require such a large capacity and cost of the automatic embroidering apparatus 20 are unnecessarily increased. Therefore in this embodiment the embroidering data on the magnetic tape 11 are read into the temporary memory RAM2 of the automatic embroidering apparatus 20, and when the capacity of the temporary memory RAM2 is filled, reading from the magnetic tape is temporarily stopped. After the contents in temporary memory RAM2 are successively issued to advance the embroidering operation part way, such reading again takes place.

Figure 7:
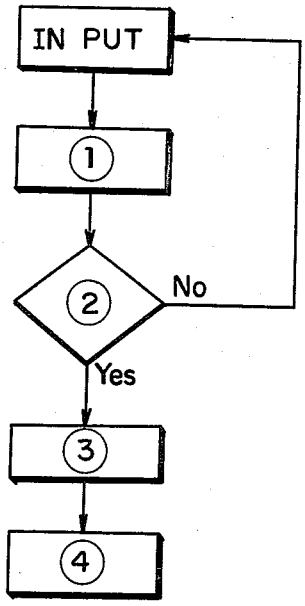
FIG. 7 is a flow chart showing part of the operation of the embroidering signal input apparatus.

In this embodiment, the magnetic tape is made, in reference to the flow chart in FIG. 7, by successively transferring the embroidering data on each point of the pattern from the temporary memory RAM1 of the input apparatus to the magnetic tape 11 while incrementing the address counter of the input apparatus 1, giving a later mentioned control signal to the magnetic tape 11 by the program in the static memory ROM1 of the input apparatus 1 when the capacity of the temporary memory RAM2 of the embroidering apparatus 20 is filled with the embroidering data, and then acting on the tape recorder 63 of the input apparatus, temporarily stopping the reading-in to the magnetic tape 11 from the temporary memory RAM1, and giving a signal from the micom COM1 in order to form the blank signal on the magnetic tape. In issuing the embroidering signal from the magnetic tape 11 to the temporary memory RAM2 by the input part 21 (FIG. 12) of the embroidering apparatus 20, the control signal acts on the micom COM2 when the amount of the embroidering data fills the capacity of the temporary memory RAM2 to stop driving of cassette reader 22 and stop the reading-out from the magnetic tape. This control signal is for temporarily stopping the sewing machine and the embroidering frame 29 after performing the automatic embroidering operation with the embroidering data provided up to that line and the embroidering data are given to said temporary memory RAM2 similarly as previously.

Next, an explanation will be had of the automatic embroidering apparatus 20. This apparatus reads out the embroidering data from the magnetic tape, after the tape has been prepared by the input apparatus 1, by means of the cassette reader 22 of the input part 21. Data on the tape is demodulated by a demodulator circuit 23 to successively issue an input to the temporary memory RAM2 and control driving of an embroidering drive circuit 24 by microm COM2 in accordance with the data in temporary memory RAM2 for carrying out automatic embroidery.

Figure 8:
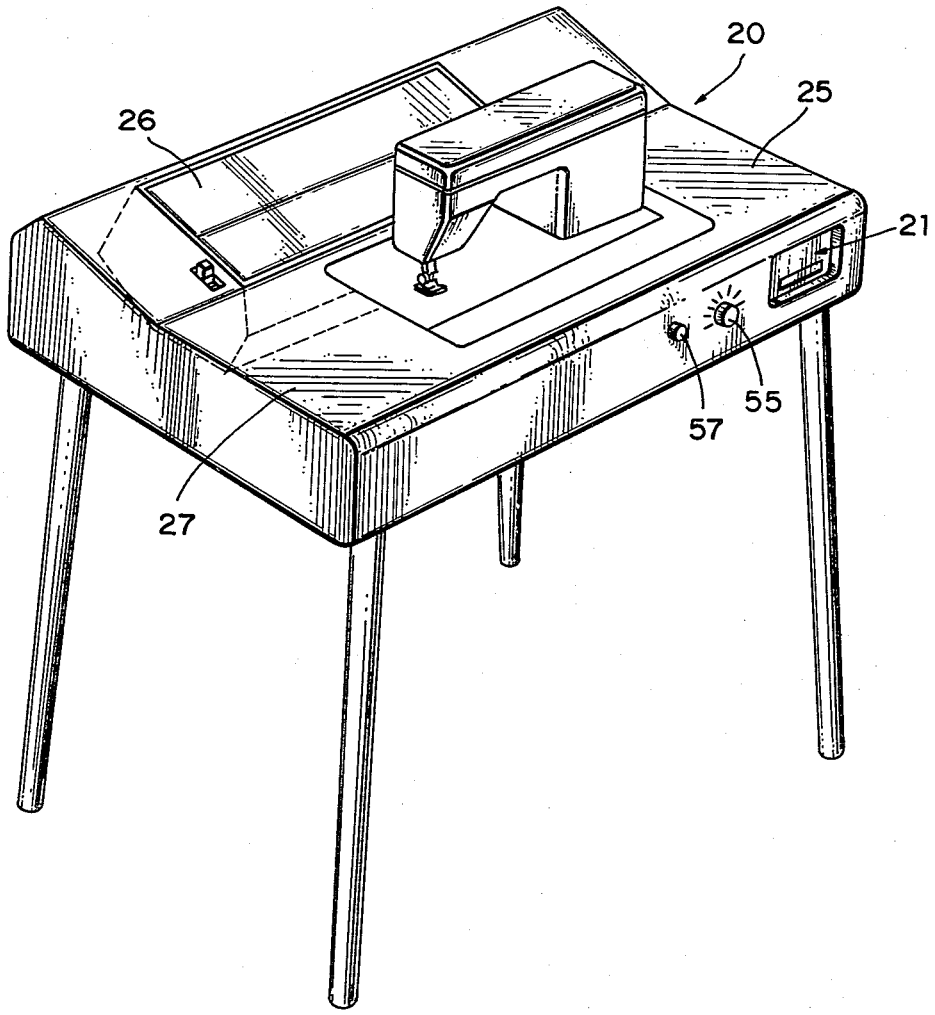
FIG. 8 is a perspective view of the automatic embroidering apparatus, shown in a normal lock stitching condition.

Further the embroidering apparatus 20 will be explained with reference to the attached drawings. In FIGS. 8 and 9, reference numeral 25 is a machine table, and numeral 26 is a casing into which a main part of the automatic embroidering apparatus 20 is installed and which can open up above a cloth support 27 of the machine table 25. This casing contains a later mentioned embroidering frame driving mechanism 28 (FIG. 10) and a main part of a control circuit 24 (FIG. 12) for controlling driving of the mechanism 28. Numeral 21 is an input part of the embroidering apparatus 20 which reads the magnetic tape storing the automatic embroidering data. As mentioned later, when the casing 26 is open (as shown in FIG. 9) an embroidering frame 29 can be connected to the driving mechanism 28 and can perform automatic embroidery together with the sewing machine, and when casing 26 is closed straight stitching can be carried out.

Figure 10:
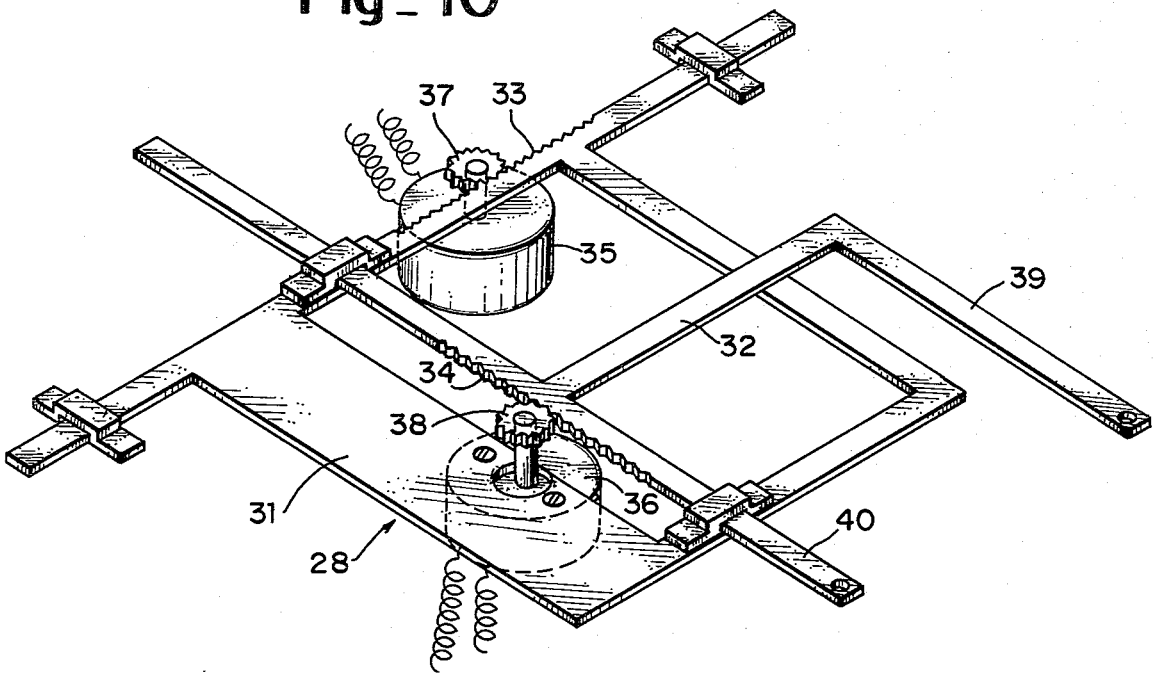
FIG. 10 is a perspective view of a mechanism for moving the embroidering frame.

The embroidering frame driving mechanism 28 incorporated in said casing 26 will be explained with reference to FIG. 10. In the same, a numeral 31 is an X-driving member and 32 is a Y-driving member, and they are respectively formed with racks 33 and 34 which are geared with pinions 37 and 38 connected to an X-control motor 35 and a Y-control motor 36. The X-control motor 35 and the Y-control motor 36 are controlled by commands from the micom COM2, and output terminals 39 and 40 are positioned and driven for the automatic embroidery. Although not shown especially, the output terminals 39 and 40 are attached with the embroidering frame 29 by an ordinary one-touch.

Figure 12:
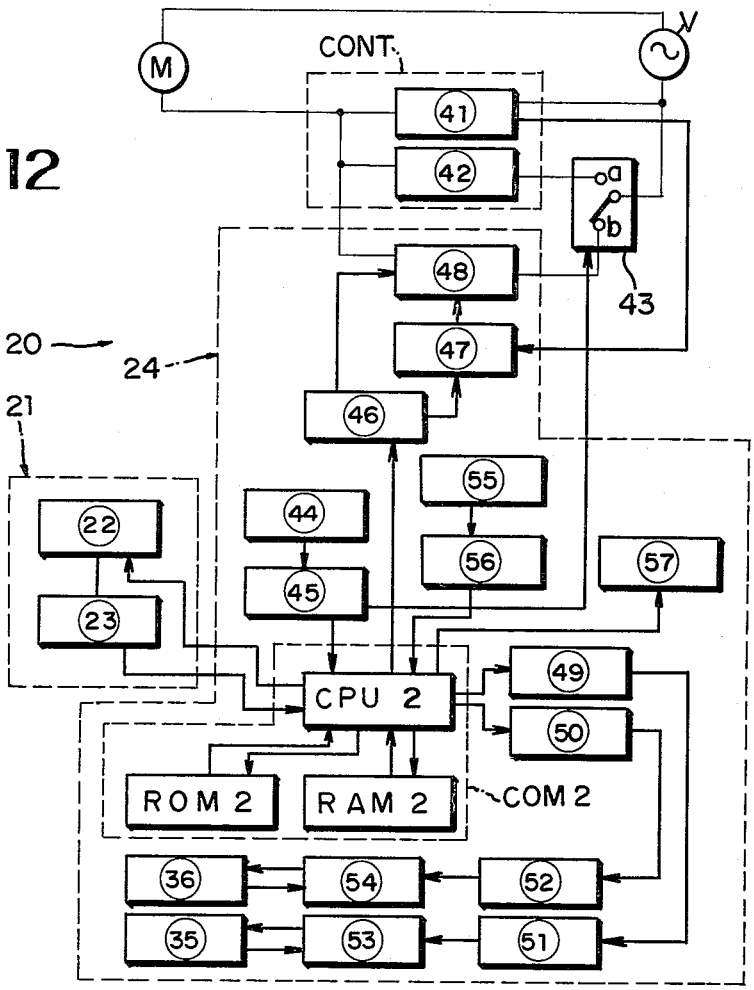
FIG. 12 is a block diagram showing control circuitry in of the automatic embroidering apparatus.

The control circuit for the automatic embroidery and the normal stitch will be explained with the block diagram. In FIG. 12, a reference mark V is an AC power source, M is a machine motor for driving the sewing machine, and CONT is a controller which during normal sewing controls speed of the machine motor M together with a machine speed control circuit 42 by stepping a controller operating part 41, and which, during automatic embroidering, serves as a switch of the embroidering speed control circuit 48 of the embroidering control circuit 24 to be operated by an order from the micom COM2. The input part 48 is for converting the embroidering data stored in the magnetic tape into the digital signal in the temporary apparatus RAM2 of the micom COM2 and storing in advance the digital signal before automatic embroidery. CPU2 is a central processing unit of said micom. The closed condition of the casing 26 is for the straight stitching, and since the connector 45 is not connected as mentioned later the wiper of switch 43 is connected to the terminal for the straight stitching of the sewing machine by the controller CONT. The opened condition of the casing 26 is for embroidering, and when the upper shaft pulse generator 44 secured on the upper shaft of the sewing machine is connected to the micom COM2 by the connecter 45, the wiper of switch 43 is connected to the b-terminal for the automatic embroidery by the control of the embroidering control circuit 24.

Figure 11:
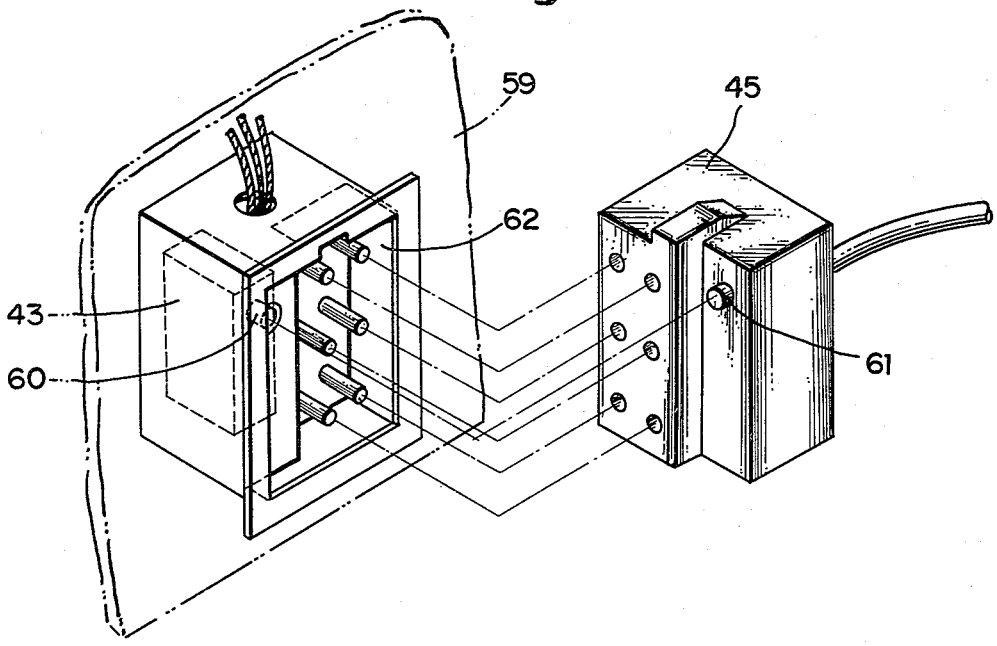
FIG. 11 is a perspective view showing a connector for an upper shaft pulse generator of the sewing machine.

In this embodiment, as shown in FIG. 11, the switch 43 is attached to the casing 59 of the sewing machine, and an operating piece 60 thereof is operated by projection 61 (located on the connector 45) when the connector 45 is connected to a connector 62 and the switch 43 is connected to the b-terminal in FIG. 12. When the switch 43 is connected to the b-terminal, the controller operating part 41 serves as a switch for operating the embroidering circuit 24 of the embroidering apparatus 20, and the speed of the machine motor M is controlled by the embroidering speed control circuit 48 (which in turn is controlled by the driving control signal 46 issued from the micom COM2 by a program stored in the static memory ROM2 in advance) and the driving control signal 46 acts on the flip-flop 47 to determine whether or not the machine motor M is rotated together with the order from the controller operating part 41 via the embroidering speed control circuit 48. Simultaneously, the micom COM2 outputs the automatic embroidering data previously stored in the temporary memory RAM2 by the magnetic tape 11 as the X-driving order 49 and the Y-driving order 50 in response to upper shaft pulses, which are generated in synchronism with the rotation of the upper shaft of the sewing machine driven by the machine motor M, and the micom COM2 controls the X-driving circuit 53 and the Y-driving circuit 54 via the D/A converters 51 and 52, and positions and controls the X-control motor 35 and Y-control motor 36 in a closed loop.

Next, reference will be made to working of the embroidering apparatus 20 by the magnetic tape 11 made by the input apparatus 1 of this embodiment. For carrying out the automatic embroidering operation, the embroidering frame 29 and the fabric are set on output terminals 39 and 40 of the embroidering frame driving mechanism 28 under when the casing 26 of the embroidering apparatus 20 is open, as shown in FIG. 9, and the magnetic tape 11 is charged on the cassette reader 22 of the embroidering apparatus 20 after a preliminary arrangement of the operation. The embroidering data stored on the magnetic tape are read out by the cassette reader 22 and demodulated by the modulation circuit 23 and successively transmit the co-ordinate signal and the control signal to the temporary memory RAM2 of the embroidering apparatus. During this period, a lamp 57 for indicating completion of the embroidering arrangement is kept off.

The input is continuously given, and when the embroidering frame comes to the disconnected part of the pattern of the magnetic tape 11 (after the sewing machine is stopped by the micom COM2 in accordance with the control signal from the magnetic tape) the embroidering frame 29 only is moved to the initial co-ordinate position of the subsequent pattern and is stopped there to control the flip-flop 47 of the embroidering apparatus 20. For embroidering a following continuous part of the pattern a signal is given such that the embroidering speed control circuit 48 is not operated unless the controller operating part 41 (serving as the switch of the embroidering control circuit 41) is released and pushed again.

The input is continuous, and when the capacity of the temporary memory RAM2 is filled, the magnetic tape issues a signal for stopping the input, and micom COM2 generates a signal for stopping driving of the cassette reader 22 and lighting lamp 57, indicating completion of the embroidering. When the upper shaft pulse generator 44 is connected to the micom COM2 by the connector 45, the wiper of the switch 43 is switched to the b-terminal to make the embroidering control circuit 24 operative, so that the machine operator may start the embroidering operation by stepping on the controller operating part 41. When the controller operating part 41 is depressed to start the embroidering operation, the embroidering frame 29 is at first positioned for driving in such a manner that the needle is dropped onto the pattern co-ordinate designated by the initial address, and thus the initial stitching takes place. Subsequently, the distance between said initial stitching and a co-ordinate to be designated by the next address is interpolated by a program in the static memory ROM2 of the micom COM2, a calculation to divide this distance is carried out by the micom COM2, and the embroidering frame 29 is controlled in driving such that said distance is stitched in order by 1/n. In this embodiment, the program of n=16 is stored in the static memory ROM2.

When the speed of rotation of the sewing machine during embroidering is controlled by the controller CONT as in straight stitching, a problem occurs in which the embroidering frame cannot follow the rotation speed of the sewing machine, and therefore during automatic embroidering according to this embodiment the rotation speed of the sewing machine is made so constant that the embroidering frame may follow the embroidering speed control circuit 48. The controller operating part 41 of the controller CONT functions as a switch to determine whether or not the embroidering speed control circuit 48 is operating as mentioned before. As to the rotation speed of the sewing machine embroidering, the maximum rotation number is determined so that the embroidering frame 29 may follow it, besides setting the tolerance within which the speed may be varied.

The embroidering frame 29 is controlled to form successively stitches by 1/n between the pattern co-ordinate to be designated by the second address and the pattern co-ordinate to be designated by the third address, and when the embroidering frame comes to the disconnected part of the pattern the sewing machine is stopped after forming the final stitch of the continuous pattern, and the needle bar is stopped nearly at the upper dead point, and only the embroidering frame 29 is moved to the initial co-ordinate position of the following continuous pattern and is stopped.

For embroidering a following continuous pattern by the order from the micom COM2 in accordance with the memory of the temporary memory RAM2 in the disconnected part of this pattern, the flip-flop 47 is so controlled that the embroidering speed control circuit 48 is not operated unless controller operating part 41 is released and pressed again, and the machine operator may exchange the thread at the disconnected part of the pattern. If the temporary memory RAM2 is programmed with only half of the embroidering patterns due to the above mentioned problem of the capacity of the temporary memory RAM2 during further embroidering, the stitching operation is carried out by successively issuing such given patterns. When issuing all of the patterns the temporary memory RAM2 must be given with rest half of them. An operation at such a case will be explained.

When the temporary memory RAM2 exhausts up the stored contents, the cartridge cassette reader 22 of the magnetic tape 11 is re-rotated and subsequent embroidering data are given to the temporary memory RAM2 in succession. Since the blank signal is formed on the magnetic tape 11 at this re-rotation any mistake in reading-out owing to unstability of the speed of response of the cassette reader 22 may be avoided. At this inputting time, the drive controlling signal 46 is issued in the same fashion as it is issued in the disconnected part of the pattern from the micom COM2 by the program of the static memory ROM2 in accordance with the signal from the magnetic tape 11 and the embroidering speed control circuit 48 is released, and the flip-flop 47 is so controlled that the sewing machine and the embroidering frame 29 are not operated unless the controller operating part 41 is released and again depressed. The cassette reader 22 is rerotated in this condition and the pattern data stored on the magnetic tape 11 are again given to the temporary memory RAM2. During this period, the lamp 57 indicating the completion of the preparation of the embroidery is kept off, and after re-input it is lighted to indicate the completion of the preparation. Thereafter, the controller operating part 41 is depressed to enable embroidering work to continue and in this case the initial co-ordinate after interpretation is drawn, and the distance between this co-ordinate and the final co-ordinate before the interpretation is combined with the straight line, and the micom COM2 carries out the calculation to divide said distance into n equal distances. The embroidering frame 29 is successively controlled in driving each of the stitches by l/n times the distance to continue the embroidery.

As mentioned above, the input apparatus of the embroidering signal converts the co-ordinates each point into the digital co-ordinate signal for the desired pattern on the co-ordinate analysis panel in order to easily store the converted signal in the temporary memory of the input apparatus. During automatic embroidering and when the sewing machine is stopped, the embroidering frame 29 is moved to the initial co-ordinate of the subsequent continuous part of the pattern on which the needle drops and the controlling signal is stored in the temporary memory of the embroidering apparatus for stopping the embroidering frame, to thereby make it convenient to change thread at the disconnected part of the pattern and to change the data for the automatic embroidery, and the sewing machine and the embroidering frame are temporarily stopped. For re-driving the sewing machine and the embroidering frame, the controller operating part is released and pushed again to heighten operating safety.

The automatic embroidering apparatus according to the present invention is to prepare the magnetic tape by repeating outputs to the magnetic tape (covering all the parts within the embroidering frame) each time that the quantity of the embroidering data stored on the magnetic tape becomes equal to the capacity of the temporary memory of the automatic embroidering apparatus. The temporary memory can thus be made of a smaller capacity, and increased cost of the apparatus avoided. Provision of a blank signal between the continuous embroidering data avoids mistakes during reading-out caused by instability of response at re-driving of the casette reader when reading out after twice to the temporary memory of the embroidering data by an input part of the automatic embroidering apparatus.

We claim:

1. An apparatus for providing embroidery information and control signals to a recorder in order to record such information and signals on a magnetic medium in a manner that the medium can be used to operate an automatic embroidery machine which includes a fixed sewing machine, a movable embroidery frame, and a temporary memory of a predetermined capacity, comprising:

an embroidery analysis panel;

a stylus pen having a coordinate switch and a control switch, the coordinate switch causing coordinates of a point on the embroidery analysis panel to be registered when the stylus pen is located at the point and the coordinate switch is operated by a user and the control switch generating a control signal when the control switch is operated by a user to indicate a last point on a continuous part of an embroidery pattern, the control signal being in a form which will cause the automatic embroidery machine to stop embroidering after said last point has been sewn prior to embroidering another continuous part of an embroidery pattern; and a microcomputer cooperating with the embroidery analysis panel, the stylus pen, the coordinate switch and the control switch and connectable to the recorder, the microcomputer classifying points so registered into at least one continuous part of an embroidery pattern and converting all points so registered into embroidery information suitable for use in an automatic embroidering machine.

2. The apparatus defined by claim 1, wherein the control signal is in a form which will cause the automatic embroidery machine to move the embroidery frame to move from said last point after said last point has been embroidered to an initial point of a next continuous part of an embroidery pattern while the sewing machine is stopped, whereby a user of the automatic embroidery machine will have an opportunity to change thread.

3. The apparatus defined by claim 2, wherein the microcomputer operates in a manner that when the information recorded on the medium equals the capacity of the temporary memory, recordation of such information on the medium is caused to cease and a blank signal is recorded thereon.

4. The apparatus defined by claim 2, wherein the control signal is further in a form which will cause the automatic embroidery machine to cease to read embroidery information from the medium.

* * * * *